United States Patent [19]

Jimena

[11] Patent Number: 4,940,177

[45] Date of Patent: Jul. 10, 1990

[54] ELECTRIC STAPLER HAVING ELECTRONIC CONTROL CIRCUIT

[76] Inventor: Carlos L. Jimena, 501 S. Marengo, Pasadena, Calif. 91101

[21] Appl. No.: 292,101

[22] Filed: Dec. 30, 1988

[51] Int. Cl.[5] ..... B25C 5/15; B25C 7/00

[52] U.S. Cl. ..... 227/7; 227/131

[58] Field of Search ..... 227/1, 2, 3, 4, 5, 6, 227/7, 131

[56] References Cited

U.S. PATENT DOCUMENTS

| | | | |
|---|---|---|---|
| 4,386,725 | 6/1983 | Chambers | 227/2 |
| 4,421,264 | 12/1983 | Arter et al. | 227/4 X |
| 4,491,260 | 1/1985 | Jimena | 227/131 X |
| 4,515,303 | 5/1985 | Schädlich et al. | 227/131 |
| 4,611,742 | 9/1986 | Rieker et al. | 227/131 |
| 4,795,071 | 1/1989 | Jacobs et al. | 227/7 |

*Primary Examiner*—Paul A. Bell

*Attorney, Agent, or Firm*—Dellett, Smith-Hill and Bedell

[57] ABSTRACT

An automatic electric stapler in which the staple driver is attached to the armature of the solenoid so that actuation of the solenoid directly impels the staple driver against the anvil of the stapler. The armature includes a central passage through which a spring extends for biasing the armature away from the anvil and through which cooling air is forced during operation of the solenoid. An electronic circuit includes a photodetector for triggering the stapler and a lockout feature preventing double triggering. A safety feature automatically removes operating power from the stapler after a predetermined time period of dormancy.

14 Claims, 2 Drawing Sheets

ELECTRIC STAPLER HAVING ELECTRONIC CONTROL CIRCUIT

BACKGROUND OF THE INVENTION

This invention relates to solenoid-driven staplers, and particularly to electronic circuits controlling the operation of such staplers.

Conventional staplers include an anvil, a guideway above the anvil through which a driver impels single staples through sheets to be fastened together and into engagement with the anvil, the free ends of the staple being thereby bent to bind the sheets together. In conventional solenoid-operated staplers, the driver, which is coupled to the armature of a solenoid, is actuated by insertion of the material to be stapled into the space between the anvil and the guideway, where the material engages a lever and closes a switch, which in turn actuates the solenoid to drive the staple. Solenoid-driven staplers, in the past, have been subject to overheating with constant, heavy use. Prior art electric staplers have utilized various mechanically operated switches to trigger the stapling operation, prevent chatter, multiple cycles and the like. See, for example, my U.S. Pat. No. 4,491,260 entitled ELECTRIC STAPLER issued to Carlos L. Jimena.

SUMMARY OF THE INVENTION

It is an object of the present invention to provide an improved electric stapler utilizing an electronic control circuit.

It is a more particular object of the present invention to provide an improved solenoid-driven stapler having an electronic control circuit and including means for cooling the staple-driving mechanism.

It is another object of the present invention to provide an improved solenoid-driven stapler with an automatic power shutoff circuit.

Another object of the instant invention is to provide an improved solenoid-driven stapler having an electronic control circuit facilitating both automatic photosensor operation and manual pushbutton operation.

These and other objects of the instant invention are achieved by providing a stapler mechanism with a solenoid-operated driver having a return-spring in a central aperture of the armature, cooling air being drawn into and expelled from the aperture when the solenoid is operated during a stapling operation. An electronic control circuit includes a photodetector that triggers the stapler when paper is inserted and a lockout circuit that prevents double triggering.

DRAWINGS

While the invention is set forth with particularity in the appended claims, other objects, features, the organization and method of operation of the invention will become more apparent, and the invention will best be understood by referring to the following detailed description in conjunction with the accompanying drawing in which:

DESCRIPTION OF THE PREFERRED EMBODIMENT

Figure 2:
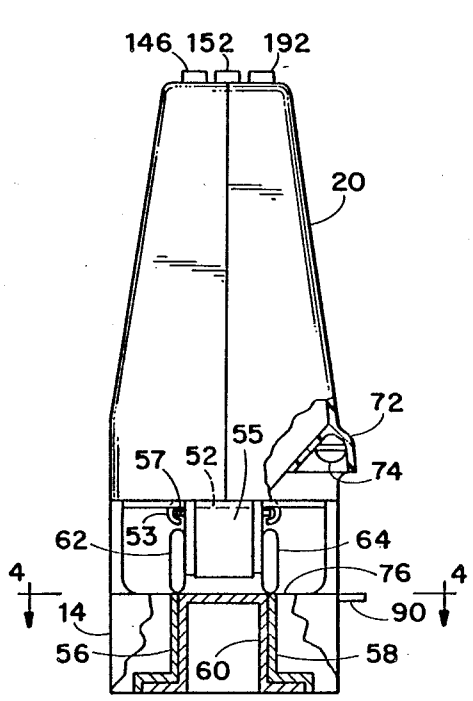
FIG. 2 is an end view, partially cut away, of the stapler of FIG. 1.
Figure 5:
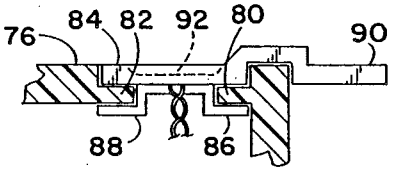
FIG. 5 is an enlarged view of the photosensor carriage taken along lines 5—5 of FIG. 4.
Figure 1:
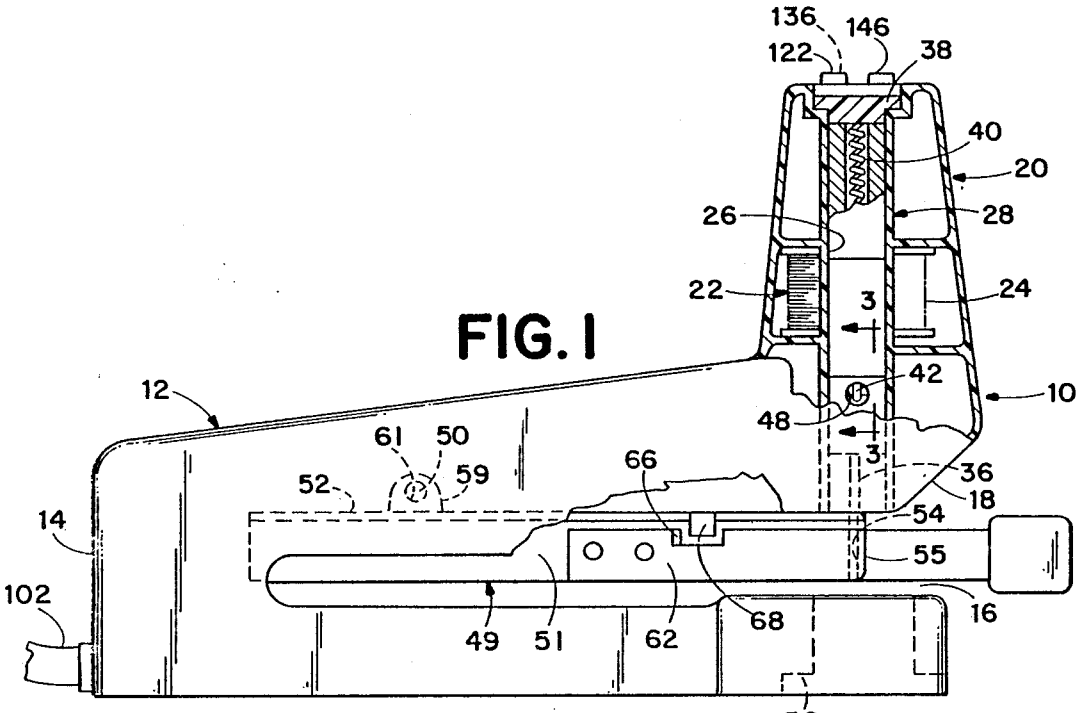
FIG. 1 is a side view, partially cut away, of a stapler according to the present invention.

Referring now to the various views of the drawing for a more detailed description of the components, materials, construction, function, operation and other features of the instant invention by characters of reference, and in which like characters denote like elements throughout the several views, FIGS. 1 and 2 illustrate an electric stapler 10 enclosed in a housing 12 suitably made of a durable thermoplastic material such as polycarbonate, and having a generally horizontally extending base or body portion 14 formed with an open horizontal slot 16 extending into the base 14 from a forward end 18 thereof, and into which slot 16 sheets of paper or other material to be fastened can be inserted. The housing 12 includes a head 20, which extends upward from the forward end 18 of the base 14 and houses a staple driving mechanism 22, while the body portion 14 of the housing holds other mechanical and electrical components of the stapler 10. The housing 12, longitudinally bifurcated, is suitably formed of two molded halves joined together by suitable fasteners (not shown).

Figure 3:
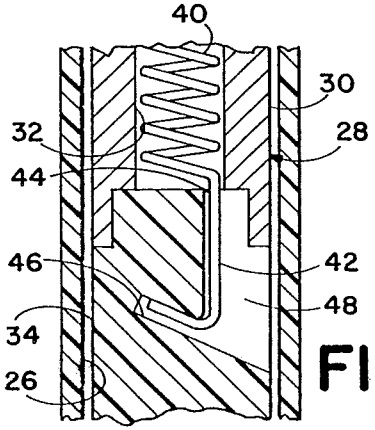
FIG. 3 is a section view taken along lines 3—3 of FIG. 1.

Referring to FIGS. 1-3, the staple driving mechanism 22 includes an annular coil 24 surrounding a cylindrical chamber 26 formed integrally with and centrally disposed within the head 20, and a plunger assembly 28, which is reciprocally movable within the chamber 26. The plunger assembly 28 comprises a metal cylinder 30 having a central bore 32 therethrough, and a nonmagnetic cylinder 34, which is suitably made of a hard plastic material such as filled polycarbonate, coaxial with the metal cylinder 30 and affixed as by bonding to the lower end of the metal cylinder 30. A conventional staple driver 36 is affixed to the lower end of the nonmagnetic cylinder 34. The annular coil 24 and the metal cylinder 30 together comprise a solenoid wherein the metal cylinder 30 functions as a vertically movable core element or armature of the solenoid, which armature propels the driver 36. When the solenoid is de-energized, the upper end of the metal cylinder armature 30 abuts an end cap 38 and is held retracted in that position by a spring member 40, which is suitably a coil spring attached or hooked to the end cap 38. The end cap 38 provides a substantially air-tight closure of the cylindrical chamber 26 at its upper end. The spring 40 passes through the central bore 32 of the cylinder 30 and includes a hooked end portion 42, which extends through an opening 44 in the upper end of the nonmagnetic cylinder 34, and anchors in a slot 46 formed in the cylinder 34. The size of the central bore 32 and the strength of coil spring 40 can be varied depending on the intended duty cycle of the stapler, e.g. a lighter weight armature 30 is easier to actuate, but cannot dissipate heat as well as a heavier armature when the duty cycle of the stapler is high, i.e., the time between successive actuations short. To alleviate the heating problem, an inlet 48 provides a passage for cooling air through the opening 44 into the central bore 32 of the armature 30, the cooling air being drawn in and expelled by the reciprocating action of the plunger assembly 28 in the chamber 26, thereby cooling the spring 40 and the armature 30.

A magazine 49 mounted by a pivot 50 to the base 14 of the housing 12 holds a strip of adhesively bonded wire staples. The magazine 49 can be of conventional construction, and accordingly many details of the construction are omitted for simplicity. The magazine 49 includes a cartridge 51 engaged slidably into a cartridge holder 52. Channels 53 formed on either side of the cartridge holder 52 slidably receive flanges 57 that extend laterally from top edges of the cartridge 51. The cartridge holder 52 is rotatably attached to the pivot 50, which is formed internally on either side of and integrally with the stapler body, by a clevis 59 having arms depending from either side of the cartridge holder 52 and including apertures 59 through which the pivot 50 extends. A spring-loaded staple follower (not shown) urges the strip of staples forward in the cartridge 51, the forwardmost staple being cantilevered over a vertically disposed guideway 54 through which the staple driver 36, when actuated, pushes the staple. The driver 36 is positioned directly over the forwardmost staple and is accurately guided in its downward movement by end plate 55 of the cartridge 51. The magazine 49 rotates about the pivot 50, descending to contact sheets of material (not shown) inserted into the slot 16 to be fastened together. A U-shaped metal anvil 56 attached to the base 14 underlies the material and intercepts the descending staple ends, which have been driven through the material, the staple ends being thereby bent to bind the sheets together. The anvil 56 thus absorbs the entire impact of the descending staple driving mechanism 22. As shown in FIG. 2, the anvil is fabricated of nested U-shaped members 58, 60, and can thus be constructed in a variety of sizes to accommodate various sizes and lengths of staples.

Spring members 62, 64, attached on either side of the cartridge 51 and extending outward from the forward end of the stapler, when manually pressed together, release retaining tab 66 on the spring member 62 from fixed tab or detent 68 on the cartridge holder 52, thus enabling the cartridge 51 to be pulled out slidably from the cartridge holder 52 for installing another strip of staples.

Figure 4:
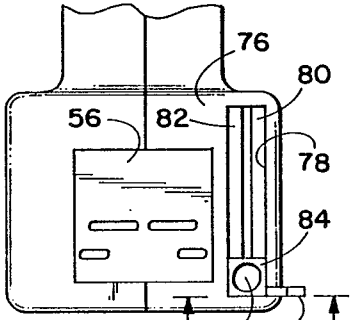
FIG. 4 is a view taken along lines 4—4 of FIG. 2.

Referring to FIGS. 2 and 4, a recessed housing 72 alongside the head 20 holds a light-emitting diode 74, which radiates light downward toward platform 76 of the base 14. An elongate slot 78 with lateral flanges 80, 82 formed in the platform 76 serves as a raceway slidably holding a photosensor carriage 84. Slide members 86, 88 attached beneath the carriage 84 engage corresponding flanges 80, 82, retaining the carriage 84 in the slot 78. Light from the diode 74 illuminates the entire length of the slot 78. A handle 90 facilitates manual adjustment of the carriage 84 along the slot 78 to position a photosensor 92, which triggers actuation of the staple driving mechanism as explained below, and determines the location of the staple in the material to be fastened together. The slot 16 is made deep enough so that standard-size sheets of paper can be inserted form the side of the stapler without covering the photosensor 92, after which the paper can be moved forward to cover the photosensor (in the position as shown in FIG. 4) and actuate the stapler. With the photosensor 92 positioned toward the other end of the elongate slot 78, i.e., away from the forward end 18 of the stapler, paper can be inserted and stapled in the conventional manner, from the forward end 18.

Figure 6:
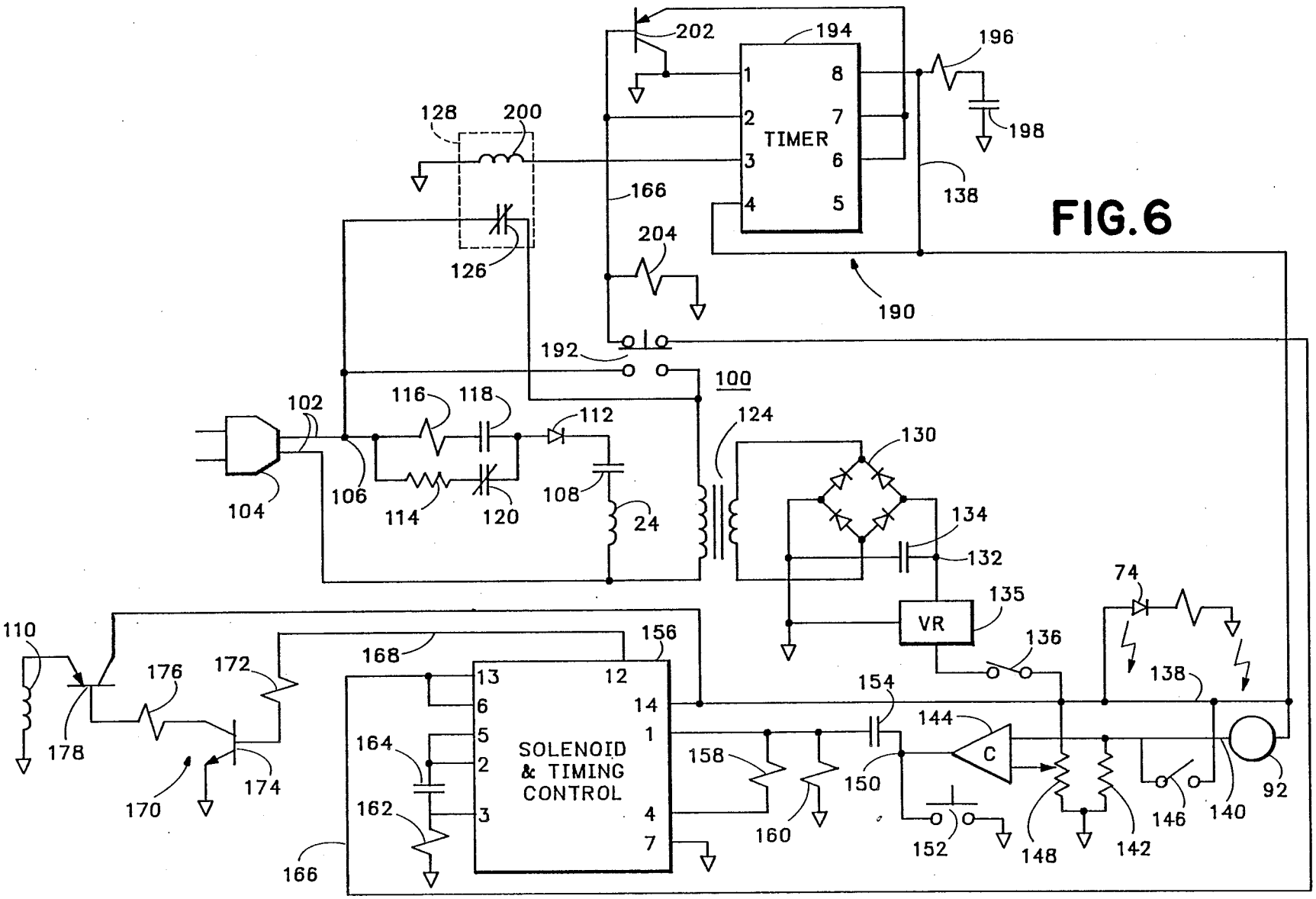
FIG. 6 is a schematic diagram of an electronic control of an automatic electric stapler according to the instant invention.

Referring now to FIG. 6 in conjunction with FIGS. 1, 2 and 4, an electronic control circuit 100 is characterized by reliability and compactness, being installed inside the housing 12 of the stapler. Power cord 102 is attached at one end to the stapler 10 and at the other end to a conventional male plug 104 which facilitates connecting the stapler to any standard 120-volt A.C. source. The coil 24 of the staple driving mechanism 22 is connected to A.C. supply node 106 through a series circuit comprising contacts 108 of a power-contactor relay 110, diode 112 and parallel current-limiting resistors 114, 116, each connected in series with corresponding contacts 118, 120 of a pushbutton switch 122, which is located atop the head 20 of the stapler. The pushbutton switch 122 is a three-position switch which varies the power applied to the coil 24 by connecting the 10 ohm 10 watt resistor 114 in the series circuit in a first position, as illustrated in FIG. 6, the 5 ohm 10 watt resistor 116 in a second position, and both resistors 114, 116 paralleled in a third position.

A stepdown power transformer 124, which is connected to the power node 106 through normally-closed contacts 126 of a relay 128, applies 12.6 volts A.C. at the secondary across a bridge rectifier 130, the output of which is approximately 8.5 volts D.C. unregulated at node 132. A 16-volt, 470 microfarad electrolytic capacitor 134 smooths the D.C. ripple. The unregulated D.C. voltage at the node 132 is applied to a voltage regulator circuit 135, which is suitably a type 7805 integrated circuit. The output of the voltage regulator, 5 volts D.C., is applied through a pushbutton power ON/OFF switch 136 to a D.C. power bus 138, which supplies D.C. operating voltage to the various components of the circuit 100 when the switch 136 is closed.

The stapler 10, during normal operation, is automatically triggered when material to be stapled together is interposed between the light-emitting diode 74 and the photosensor 92. The photosensor 92 is connected between the 5-volt power bus 138 and output node 140, which is connected through a 2.2 kiloohm (K-ohm) resistor 142 to ground and to one input of a comparator circuit 144, suitably an LM 311 operational amplifier. An AUTOMATIC/MANUAL push-button switch 146 is connected between the output node 140 and the bus 138. A potentiometer 148 connected between the power bus 138 and ground provides an adjustable reference voltage to another input of the comparator 144. Light striking the photosensor 92 causes the resistance therethrough to decrease, increasing the voltage drop across the resistor 142 and raising the voltage on the node 140. When voltage on the node 140 is greater than the reference voltage at the potentiometer 148, output node 150 of the comparator 144 goes high, nominally 5 volts. When light on the photosensor 92 is blocked, indicating that paper has been inserted into the stapler, the voltage on node 140 decreases, and when below the reference voltage at potentiometer 148, the comparator output node 150 goes low, nominally zero volts, which triggers the stapler as detailed below. The potentiometer 148 controls the sensitivity of the comparator circuit 144.

The AUTOMATIC/MANUAL switch 146, when closed, places the stapler in the MANUAL mode, short circuits the photosensor 92 and applies 5 volts from the bus 138 to the node 140 at the input of the comparator 144, thus holding the output node 150 high regardless of the light striking the photosensor. A STAPLE switch 152, which is a momentary-contact pushbutton switch connected between the node 150 and ground, when actuated, grounds the node 150 triggering the stapler.

The comparator 144 output node 150 is coupled through a 47 microfarad capacitor 154 to the input of a solenoid and timing control circuit 156, which in the presently described embodiment is a 7404 integrated circuit module manufactured by ECG. The 7404 circuit module 156 contains a number of standard circuits: bistables, logic gates, inverters, etc., details of which are omitted from the illustration of FIG. 6 for simplicity. However, input/output terminals of the module 156 are denoted herein by pin numbers corresponding with those of the manufactured 7404 module, which pin numbers are shown inside the block 156 of FIG. 6. External components that complete the implementation of the solenoid and timing control circuit 156 include a 1 K-ohm resistor 158 connected between pin 4 and the input terminal, pin 1; a 2.2 K-ohm resistor 160 connected between pin 1 and ground; a 330 ohm resistor 162 connected between pin 3 and ground; and a 4.7 microfarad coupling capacitor 164 connected between pins 2 and 3, pins 2 and 5 being connected together. Pin 14 of the circuit module 156 is connected to the D.C. power bus 138, and pin 7 is grounded. A timing output node 166 of the circuit module 156 is connected to pins 6 and 13 thereof, while a solenoid control output node 168 is connected to pin 12.

When the voltage on input node pin 1 of the circuit module 156 changes from high to low, a positive pulse 20 milliseconds in duration is emitted at pin 2. Responsive to the input of the 20 ms pulse coupled to pin 3, the circuit module 156 generates a positive reset level at pin 4, which prevents the circuit from triggering more than once each time the stapler is actuated. Responsive to the input of the 20 ms pulse on pin 5, the circuit module 156 inverts and emits the pulse at the output node 166, and this inverted pulse, input at pin 6, is again inverted and emitted on the output node 168 at pin 12. The 20 ms pulse on the node 168 is coupled to the input of a relay driver circuit 170, which provides the current needed to drive the relay coil 110 closing the contacts 108 and energizing the stapler solenoid coil 24.

The relay driver circuit comprises a 200 ohm resistor 172 connecting the node 168 to the base of an NPN transistor 174. The collector of transistor 174 is connected through a 10 ohm resistor 176 to the base of a PNP transistor 178, and the emitter of transistor 174 is grounded. The collector of transistor 178 is connected to the D.C. power bus 138, and the emitter is connected to the power-contactor relay coil 110.

An automatic shutoff circuit 190 comprises the relay 128, a DPDT pushbutton switch 192 and a timer circuit module 194, which is suitably a type NTE955M integrated circuit module manufactured by ECG. The circuit module 194 contains a number of standard circuits, which for simplicity are omitted from the illustration of FIG. 6; however, input/output terminals of the module 194 are denoted herein by pin numbers corresponding with those of the manufactured NTE955M module, which pin numbers are shown inside the block 194 of FIG. 6. The D.C. power bus 138 is connected to pin 8 of the timer circuit module 194, and a 1.5 megohm resistor 196 connected from pin 8 in series with a 33 microfarad capacitor 198 to ground establishes a time constant of approximately 90 seconds, a timeout period during which A.C. power is applied to the stapler. When 5-volt power is applied to the timer module 194 at pins 4 and 8, if the stapler is not triggered before the 90-second timeout period elapses, the relay 128 is actuated by the timer module 194 via pin 3, energizing coil 200 and opening contacts 126, which disconnects A.C power from the stapler. If, however, the stapler is triggered during the timeout period, the negative 20 millisecond pulse generated on the timing output node 166 is applied via normally-closed contacts of the switch 192 to reset circuits of the timer module 194 at pin 2, and at pins 6 and 7 via PNP transistor 202, which resets the timer and initiates another 90-second timeout period. After the timer module 194 has disconnected A.C. power to the stapler by way of the relay 128, the stapler can be enabled again by depressing the pushbutton switch 192, closing the normally-open contacts thereof, which bypasses the relay 128 and applies A.C. power to the transformer 124. Simultaneously, the normally-closed contacts of the switch 192 are opened, applying ground to the reset circuits of the timer module 194 through 2.2 K-ohm resistor 204, which resets the timer module as soon as D.C. power is applied to pin 8 via the bus 138. If the stapler is unused for another 90 seconds, the timer circuit will again disconnect the A.C. power. During the 90-second timeout period, the light-emitting diode 74 is energized and functions as a pilot light indicating that power is applied to the stapler and it is ready for use.

Components not identified above used to construct the presently described embodiment of the automatic control circuit 100 are listed below with the manufacturer's or supplier's part number:

| | |
|---|---|
| Diode 74 | Radio Shack 276-066 |
| Photosensor 92 | Radio Shack 276-116A |
| Relay 110 | OMRON 08C-1114P-OS-DC5 |
| Diode 112 | 1N4003 |
| Transformer 124 | Archer 273-1385A |
| Relay 128 | Radio Shack 275-243 |
| Rectifier 130 | NTE 5305 |
| Transistor 174 | 2N3904 |
| Transistor 178 | 2N3906 |
| Transistor 202 | 2N3906 |

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. In a machine for fastening a staple into one or more sheets of paper:

a solenoid having an operating coil and an armature, the armature being movable inside a vertically disposed chamber, the armature having an interior air passage therethrough with said passage being open to a lower end of said chamber for cooling purposes;

a staple driver attached to the armature of the solenoid;

an anvil disposed to receive impact of the staple driver when the operating coil of the solenoid is energized to actuate the armature;

spring means interiorly disposed in the armature for biasing the armature away from the anvil to a retracted position when the operating coil is de-energized;

a photosensor near the anvil;

a source of light illuminating the photosensor; and circuit means responsive to insertion of paper to be stapled between the light source and the photosensor for energizing the operating coil of the solenoid from a source of operating voltage to actuate the armature of the solenoid and drive a staple.

2. The stapling machine according to claim 1 wherein the circuit means includes means for inhibiting the solenoid from being energized a second time until after the paper is removed from between the light source and the photosensor.

3. The stapling machine according to claim 1, further comprising timing means for disconnecting the source of operating voltage from the stapling machine after a predetermined time period, the timing means being responsive to the circuit means upon energizing the solenoid to restart the predetermined timing period.

4. The stapling machine according to claim 1, further comprising means for controlling the power applied to the operating coil of the solenoid by connecting one or more selectable power-limiting resistors in an energizing circuit of the operating coil.

5. The stapling machine according to claim 1, further comprising means for disabling the photosensor; and manual actuating means, the circuit means being responsive to the manual actuating means for energizing the operating coil of the solenoid from the source of operating voltage to actuate the armature of the solenoid.

6. The stapling machine according to claim 1, further comprising means for adjusting the position of the photosensor relative to the anvil whereby the position of the staple relative to the paper to be stapled can be predetermined.

7. In a machine for fastening a staple into one or more sheets of paper:

a solenoid having an operating coil and an armature, the armature being movable inside a vertically disposed chamber, the chamber being surrounded by the operating coil of the solenoid and enclosed at an upper end, the armature having an air passage therethrough open to a lower end of the chamber;

a staple driver attached to the armature of the solenoid toward the lower end of the chamber;

an anvil disposed below the lower end of the chamber to receive impact of the staple driver when the operating coil of the solenoid is energized to actuate the armature and drive a staple;

spring means disposed inside the air passage of the armature for biasing the armature away from an anvil to a retracted position when the operating coil is de-energized;

a photosensor near the anvil;

circuit means responsive to covering the photosensor with articles to be stapled for energizing the operating coil of the solenoid, whereby the armature, upon being moved downward through the chamber by the energized operating coil, draws air through the air passage and into the chamber, the air being expelled from the chamber through the air passage when the armature is retracted into the chamber by the spring means after the operating coil is de-energized, the solenoid and spring means being cooled by ingress and egress of the air.

8. The stapling machine according to claim 7, further comprising means for adjusting the position of the photosensor relative to the anvil whereby the position of the staple relative to the paper to be stapled can be predetermined.

9. An automatic machine for fastening a staple into one or more sheets of paper, comprising:

a housing;

a solenoid having an operating coil and an armature, the armature being movable inside a chamber vertically disposed int he housing, the chamber being surrounded by the operating coil and enclosed at an upper end, the armature having an air passage therethrough open to a lower end of the chamber, the operating coil surrounding the chamber;

a staple driver attached to the armature of the solenoid toward the lower end of the chamber;

an anvil disposed below the lower end of the chamber;

a staple dispensing magazine attached to the housing and having an end disposed between the staple driver and the anvil;

spring means for biasing the armature away from the anvil, the spring means being disposed inside the air passage;

a source of operating voltage;

a photosensor near the anvil;

means for adjusting the position of the photosensor relative to the anvil whereby the position of the staple relative to paper to be stapled can be predetermined;

a source of light illuminating the photosensor; and circuit means responsive to insertion of the paper to be stapled between the light source and the photosensor for energizing the operating coil from the source of operating voltage, the armature, upon being moved downward through the chamber by energizing the operating coil to drive a staple, drawing air through the air passage and into the chamber, the air being expelled from the chamber through the air passage when the armature is retracted into the chamber by the spring means after the operating coil is de-energized, whereby the solenoid and spring means are cooled by ingress and egress of the air, the circuit means including means for inhibiting the solenoid from being energized a second time before the paper is removed from the stapler.

10. The stapling machine according to claim 9, further comprising a timer disconnecting the source of operating voltage from the stapling machine after a predetermined time period, the timer being responsive to the circuit means upon energizing the solenoid to restart the predetermined time period.

11. The stapling machine according to claim 9, wherein the staple dispensing magazine comprises:

a cartridge holder;

a staple cartridge slidably engaged in the cartridge holder; and disengagable means for holding the staple cartridge in the cartridge holder, which when disengaged allows the staple cartridge to be removed from the cartridge holder for loading a supply of staples into the staple cartridge.

12. The stapling machine according to claim 9, wherein the means for adjusting the position of the photosensor comprises a carriage in which the photosensor is mounted, the carriage being longitudinally slidable along one side of the anvil.

13. The stapling machine according to claim 9, wherein the housing is longitudinally bifurcated and formed from plastic.

14. An automatic machine for fastening a staple into one or more sheets of paper, comprising:

a housing;

a solenoid having an operating coil and an armature, the armature being movable inside a chamber vertically disposed in the housing, the chamber being surrounded by the operating coil and enclosed at an upper end, the armature having an air passage therethrough open to a lower end of the chamber, the operating coil surrounding the chamber;

a staple driver attached to the armature of the solenoid toward the lower end of the chamber;

an anvil disposed below the lower end of the chamber;

a staple dispensing magazine attached to the housing and having an end disposed between the staple driver and the anvil wherein the staple dispensing magazine comprises a cartridge holder, a staple cartridge slidably engaged in the cartridge holder, and disengagable means for holding the staple cartridge in the cartridge holder, which when disengaged allows the staple cartridge to be removed from the cartridge holder for loading a supply of staples into the staple cartridge;

wherein the disengagable holding means comprises a detent affixed to either side of the cartridge holder, and a spring member attached on either side of the staple cartridge, each of the spring members having a protruding tab engaged with a corresponding one of the detents to hold the staple cartridge in the cartridge holder, the spring members upon being pressed together releasing the tabs from the detents;

spring means for biasing the armature away from the anvil, the spring means being disposed inside the air passage;

a source of operating voltage;

a photosensor near the anvil;

a source of light illuminating the photosensor; and circuit means responsive to insertion of the paper to be stapled between the light source and the photosensor for energizing the operating coil from the source of operating voltage, the armature, upon being moved downward through the chamber by energizing the operating coil to drive a staple, drawing air through the air passage and into the chamber, the air being expelled from the chamber through the air passage when the armature is retracted into the chamber by the spring means after the operating coil is de-energized, whereby the solenoid and spring means are cooled by ingress and egress of the air, the circuit means including means for inhibiting the solenoid from being energized a second time before the paper is removed from the stapler.

* * * * *

UNITED STATES PATENT AND TRADEMARK OFFICE

CERTIFICATE OF CORRECTION

PATENT NO. : 4,940,177

DATED : July 10, 1990

INVENTOR(S) : Carlos L. Jimena

It is certified that error appears in the above-identified patent and that said Letters Patent is hereby corrected as shown below:

Column 3, line 58, delete "form" and substitute --from--.

Column 7, line 57, after the semicolon (;) add --and--.

Column 8, line 11, delete "int he" and substitute --in the--.

Signed and Sealed this

Seventh Day of July, 1992

*Attest:*

DOUGLAS B. COMER

*Attesting Officer*

*Acting Commissioner of Patents and Trademarks*